US011402185B1

(12) United States Patent
Wong et al.

(10) Patent No.: US 11,402,185 B1
(45) Date of Patent: Aug. 2, 2022

(54) PROJECTILE WITH IMPROVED FLIGHT PERFORMANCE

(71) Applicant: U.S. Government as Represented by the Secretary of the Army, Dover, NJ (US)

(72) Inventors: Brian Wong, Hamburg, NJ (US); Marco Duca, Dover, NJ (US); Thomas Presutti, Long Valley, NJ (US); Eric Skoglund, Doylestown, PA (US); Nicholas Grossman, Sparta, NJ (US); Anthony Farina, Hackettstown, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 323 days.

(21) Appl. No.: 16/596,000

(22) Filed: Oct. 8, 2019

(51) Int. Cl.
*F42B 10/26* (2006.01)
*F41H 13/00* (2006.01)
*F42B 10/46* (2006.01)

(52) U.S. Cl.
CPC ..... *F42B 10/26* (2013.01); *F41H 13/0025* (2013.01); *F42B 10/46* (2013.01)

(58) Field of Classification Search
CPC ..... F41B 10/26; F41B 10/46; F41H 13/0025; F41H 13/0035
See application file for complete search history.

(56) References Cited

U.S. PATENT DOCUMENTS 4,478,150 A 10/1984 Sayer
5,473,501 A * 12/1995 Claypool ..... H05C 1/04 361/232
5,698,815 A * 12/1997 Ragner ..... F41H 13/0006 102/504
6,782,828 B2 8/2004 Widener
6,862,994 B2 * 3/2005 Chang ..... H05C 1/06 119/908
6,880,466 B2 * 4/2005 Carman ..... F41H 13/0031 119/908
7,065,915 B2 * 6/2006 Chang ..... F41C 9/00 42/84
7,237,352 B2 * 7/2007 Keely ..... F41H 13/0031 361/232
7,327,549 B2 * 2/2008 Smith ..... H05C 1/04 361/232
7,568,433 B1 8/2009 Farina
(Continued)

*Primary Examiner* — Michelle Clement
(74) *Attorney, Agent, or Firm* — John P. DiScala

(57) ABSTRACT

A projectile having a spin stabilized gyroscopically stable flight path due to a base flange. With the base flange, the aerodynamic overturning moment about the center of gravity is reduced to increase the gyroscopic stability factor for stable flight. In one application, a medium-caliber untethered human electro-muscular incapacitation (HEMI) projectile has improved effectiveness due to its stable flight from launch to targets. Other applications for damping resulted in significant improvement in ground dispersion of 40 mm projectiles. The increased stability and increased aerodynamic damping reduce coning motion during flight which ensures that the projectile arrives at the target with greater accuracy, and with its nose oriented for effective incapacitation of the target.

10 Claims, 4 Drawing Sheets

(56) References Cited

U.S. PATENT DOCUMENTS

| | | | | |
|---|---|---|---|---|
| 7,701,692 | B2 * | 4/2010 | Smith | F41H 13/0018 361/232 |
| 7,793,591 | B1 | 9/2010 | Van Stratum | |
| 7,856,929 | B2 * | 12/2010 | Gavin | F41H 13/0025 361/232 |
| 7,984,676 | B1 * | 7/2011 | Gavin | F42B 5/073 361/232 |
| 8,074,573 | B1 * | 12/2011 | Linker | F41H 13/0025 102/502 |
| 8,205,556 | B1 | 6/2012 | Keith | |
| 8,424,456 | B2 | 4/2013 | Broden | |
| 8,547,679 | B2 * | 10/2013 | Gavin | F41H 13/0025 361/232 |
| 8,661,983 | B1 | 3/2014 | Scarr | |
| 8,896,982 | B2 * | 11/2014 | Beechey | F41H 13/0018 102/504 |
| 9,125,389 | B1 * | 9/2015 | Calvert | A01K 79/02 |
| 9,329,007 | B2 * | 5/2016 | Krauss | F42B 10/32 |
| 9,381,372 | B2 * | 7/2016 | Cheatham, III | A61N 1/046 |
| 9,618,303 | B2 * | 4/2017 | Hensler | F41H 13/0031 |
| 9,816,789 | B1 * | 11/2017 | Hyde | F41H 13/0025 |
| 2007/0214993 | A1 * | 9/2007 | Cerovic | F41H 13/0018 102/502 |
| 2021/0318106 | A1 * | 10/2021 | Bruno | F42B 12/40 |

* cited by examiner

PROJECTILE WITH IMPROVED FLIGHT PERFORMANCE

STATEMENT OF GOVERNMENT INTEREST

The inventions described herein may be manufactured, used and licensed by or for the United States Government.

FIELD OF THE INVENTION

The invention relates in general to spin stabilized projectiles, and in particular to spin stabilized projectiles with low gyroscopic stability, or low aerodynamic damping, or both.

BACKGROUND OF THE INVENTION 40 mm grenade rounds are widely used by military and law enforcement personnel. Versatile due to their relatively spacious interior volume, 40 mm grenades may be outfitted with various payloads depending on intended application. For example, 40 mm grenades may be outfitted with illumination or smoke compounds, non-lethal riot control gases, and parachutes, on board sensors and controllers or other electronic assemblies. While originally used as an area effect weapon, they are increasingly being used to deliver payloads which require more precision.

However, there are downsides associated with using 40 mm grenades for precision roles. The low length-to-diameter ratio of 40 mm grenades (typically 2.5) do not provide sufficient aerodynamic damping inflight to damp down any angular motion imparted by the launcher. As such, the achievable max range of these projectiles is reduced. With large round to round variability in motion, the accuracy of these 40 mm rounds are also adversely affected.

One such role in which 40 mm grenades may be used is in non-lethal weapon systems. Non-lethal weapon systems are valuable assets for law enforcement and military services. Non-lethal weapons may be deployed against unruly individuals to temporarily disable the individual so that they can be taken into custody or allow the user to retreat to safety. The primary intent of these projectiles is to be non-lethal and not cause traumatic or long term injury yet still cause incapacitation.

Human Electro-Muscular Incapacitation (HEMI) devices incapacitate by delivering an electrical waveform that overpowers the normal electrical signals within the subject's nervous system and causes involuntary muscle contraction and temporary loss of motor control. Currently available HEMI devices include the TASER® X26 and Taser® M26 available from Axon Enterprise, Inc. of Scottsdale, Ariz. and the 5-200 available from Stinger™ Systems, Inc. of Tampa, Fla. These devices operate by firing tethered barbs which penetrate the skin of an individual. An electric waveform is then delivered from the weapon system through the tethers and into the individual via the barbs.

While the above approach has been successful, there are downsides to this approach. Namely, the need for a tether to deliver the electric waveform limits the range and accuracy of the projectiles. In addition, a user may only incapacitate one individual at a time. The tethers further limit the magnitude and duration of the non-lethal electro-muscular disruption (EMD) effect. Finally, such projectiles require a unique dedicated weapon system.

Self-contained projectiles which do not rely on tethers have been proposed. However, previous efforts have been unsuccessful in developing a projectile which is effective at the ranges desired. In particular, previous efforts for the HEMI round have been shown to have low gyroscopic stability which adversely affected its effectiveness.

Accordingly, a need exists for a 40 mm projectile with more stable flight. In particular, a need exists for a self-contained HEMI projectile with improved stability to allow for effective performance at the desired ranges.

SUMMARY OF INVENTION

One aspect of the invention is a projectile having a spin stabilized gyroscopically stable flight path. The projectile comprises a payload, an ogival nose region, a midsection region, and a base region. The base region further comprises a base flange. With the base flange, the aerodynamic overturning moment about the center of gravity is reduced to increase the gyroscopic stability factor (Sg) above 1.0 or greater for stable flight. In this manner, the base flange functions as a stabilizer.

A specific aspect of the invention is an untethered HEMI projectile having a spin stabilized gyroscopically stable flight path. The HEMI projectile comprises a rounded ogival nose region, a midsection region, a base region and one or more prongs. The base region further comprises a base flange acting as a stabilizer. The one or more prongs which upon impact with a target, extend through an exterior surface of the rounded ogival region to deliver an electric waveform to an individual. The projectile has a center of pressure positioned forward of the center of gravity such that the projectile comprises a gyroscopic stability factor of 1.4.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A 40 mm projectile comprises an aerodynamic nose and a base flange to increase the flight stability of the projectile. In particular, the gyroscopic stability factor (Sg) and aerodynamic damping are increased through these modifications. The increased stability allows for improved projectile flight overall. Additionally, the increased aerodynamic damping significant reduced round to round dispersion, resulting in a longer effective range, with greater accuracy, than previous 40 mm projectiles that have no base flange.

The projectile is described herein as being a 40 mm projectile for use with a grenade launcher weapon system. However, the principles may be adapted to projectiles of other calibers or payloads which necessitate a rearward shift of the normal force center of pressure for a gyroscopically stable flight. For projectiles that are already gyroscopically stable, incorporating the flange further provides for increased aerodynamic damping of any angular motion induced during launch, resulting in greater accuracy.

In one application, the increased damping of the base flange resulted in significant improvement in round-to-round dispersion on the ground of a 40 mm extended range projectile.

Figure 1:
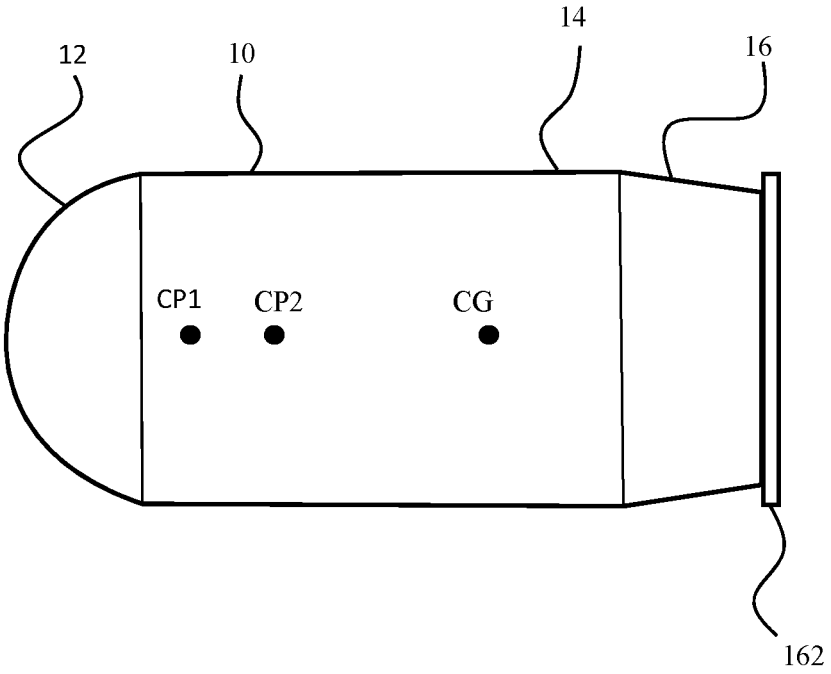
FIG. 1 is a side view of a projectile with a flange at the base, according to an illustrative embodiment.

FIG. 1 is a side view of a projectile with a base flange, according to an illustrative embodiment. The projectile 10 is a spin stabilized projectile designed to be fired from a cartridge case through a rifled weapon barrel or tube. In the embodiment shown, the projectile 10 is a 40 mm projectile and is configured to be fired from a grenade launcher of that caliber, such as the Mk19 high velocity grenade launcher, or M203 low velocity grenade launcher.

The projectile body defines an interior volume which houses a payload. The payload may be anything intended to be delivered by a projectile 10. For example, the payload may comprise any one or more of: an energetic charge, a warhead, pre-formed fragments, an electronic assembly, a deceleration means, a non-lethal payload, a visual aid, a visual obscurant or any multitude of components or compositions.

The projectile 10 is generally cylindrical in shape and comprises an ogival nose region 12, a cylindrical midsection region 14 and a tail region 16. In the embodiment shown, the regions of the projectile 10 are formed integrally with each other. In other embodiments, one or more regions may be connected to the other through suitable means. The projectile 10 is formed from a material suitable for the application. For example, in certain embodiments, one or more regions of the projectile 10 may be formed from among a metal, plastic, foam, rubber or any other materials.

Critically, the center of pressure CP2 of the projectile 10 is forward of the center of gravity CG. As will be described further below, the base flange enables a shift in center of pressure from CP1 to CP2, thereby reducing the aerodynamic overturning moment. The shift in center of pressure together with the gyroscopic effect of the spinning projectile results in a stable projectile with a gyroscopic factor (Sg) greater than 1.0.

The ogival nose region 12 is shown with a rounded nose for aerodynamic effect. The ogival nose region 12 is shaped such that the normal force on the ogive is lessened with the effect of shifting the overall center of pressure rearward. As will be described further below, a HEMI projectile nose is shaped to contain electrodes in the form of prongs and for the ease of their deployment.

The ogival nose region 12 is integrally connected to the midsection region 14. The midsection region 14 is cylindrical in shape with a constant outer diameter.

The tail region 16 is frustoconical, or boattail, in shape with a circumferential flange 162 located at the base. The flange 162 serves to increase the amount of normal force behind the center of gravity CG. Increasing the amount of normal force behind the center of gravity CG with a flange has the effect of shifting the overall center of pressure rearward, from CP1 (without base flange) to CP2 (with base flange), which reduces the overturning moment to increase the Sg. In addition, the base flange 162 serves to increase the aerodynamic damping which results in improved accuracy. The outside diameter of the tail region 16 decreases linearly in diameter until reaching a nadir at the base where the base flange 162 is located. The base flange 162 is generally disc-shaped having an outside diameter approximately equal to the land diameter of the rifling of the gun barrel to avoid any unnecessary engraving.

The rounded nose region 12 and the base flange 162 combine to shift the center of pressure of the projectile 10 rearward from CP1 to CP2, while remaining forward of the center of gravity CG.

Figure 2A:
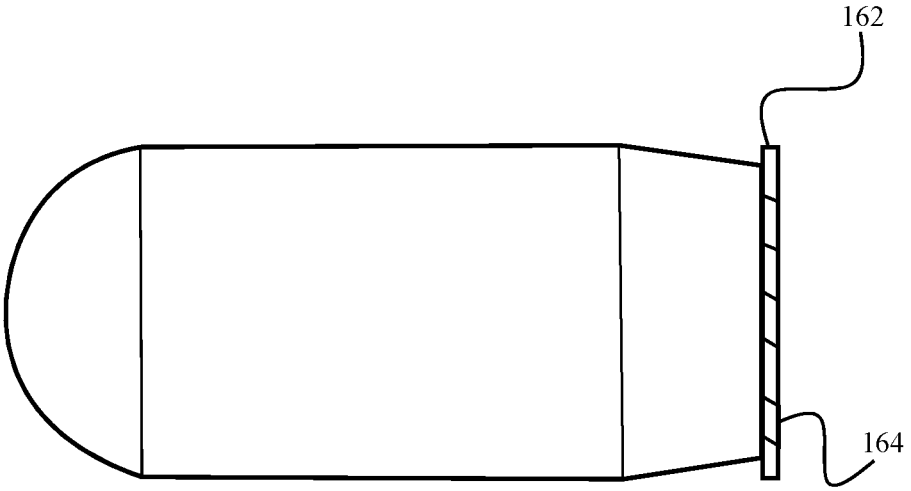
FIG. 2A is a side view of a projectile with a slotted base flange, according to an illustrative embodiment.
Figure 2B:
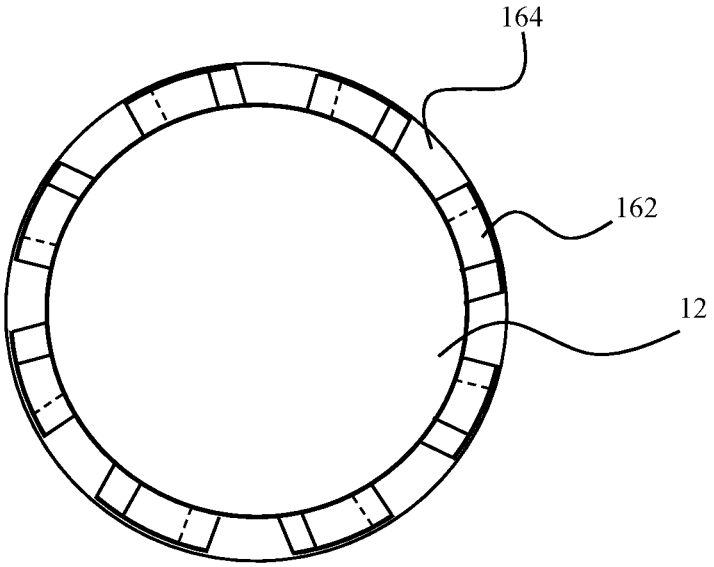
FIG. 2B is a rear view of a projectile with a slotted base flange, according to an illustrative embodiment.

The base flange 162 may be slotted or unslotted. A slotted base flange 162 may further increase the gyroscopic stability of the projectile 10 by increasing the spin of the projectile 10. FIG. 2A is a side view of a projectile with a slotted base flange, according to an illustrative embodiment. FIG. 2B is a rear view of a projectile with a slotted base flange, according to an illustrative embodiment. The base flange 162 defines one or more slots 164 that are disposed at an angle relative to the longitudinal axis of the projectile 10. As air flows past the tail region 16, it enters the slots 164 and induces a spin on the projectile 10. While in the embodiment shown, the base flange 162 comprises eight slots 164, the base flange 162 may comprise more than or less than eight slots 164.

Figure 3:
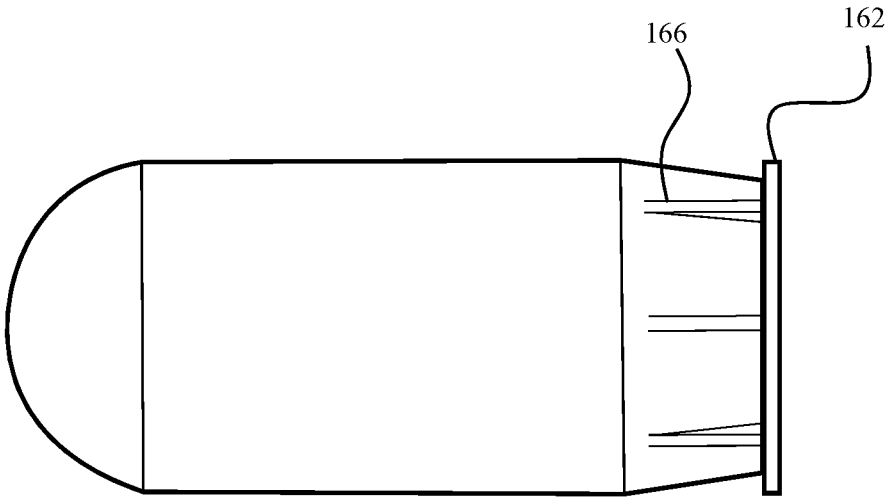
FIG. 3 is a side view of a projectile with strakes, according to an illustrative embodiment.

FIG. 3 is a side view of a projectile with strakes, according to an illustrative embodiment. The base flange 162 may further comprise one or more strakes 166 connecting the base flange 162 to the boattail. In another embodiment, the strakes may be combined with the slots 164 in the base flange 162 to further stabilize the projectile 10. In this embodiment, the strakes 166 may serve to direct airflow through the slots 164 thereby increasing the spin induced on the projectile 10 while providing for structural support that may be needed for the flange.

HEMI Projectile

The principles described above may be applied to various projectiles to improve their effectiveness. For example, in one embodiment, a medium caliber untethered human electro-muscular incapacitation (HEMI) projectile comprises a base flange and rounded nose to increase the gyroscopic stability factor over previous solutions. The increased stability reduces coning motion during flight which ensures that the projectile arrives at the target with its nose oriented correctly for effective incapacitation of the target.

A HEMI projectile without a tether has substantially increased effectiveness and versatility compared to traditional tethered solutions. The projectile may be fired from existing weapon systems and not dedicated weapon systems. The range of the projectile is increased to over 35 meters and accuracy is increased out to those ranges. Additionally, the incapacitating effects may be increased by delivering an electric waveform for longer duration but with less intensity.

However, effective incapacitation by the HEMI projectile requires that the projectile strike a target with its nose in-line with its line of flight with little margin of error. Accordingly, coning motion must be kept to a minimum. Analysis of previous ineffective solutions showed a coning angle of approximately twenty degrees. Proper operation of the HEMI projectile requires an angle no more than 5 degrees at the time of impact with the intended target. To achieve these desired results, the projectile 20 needed a gyroscopic stability factor (Sg) of about 1.4 during launch.

Figure 4:
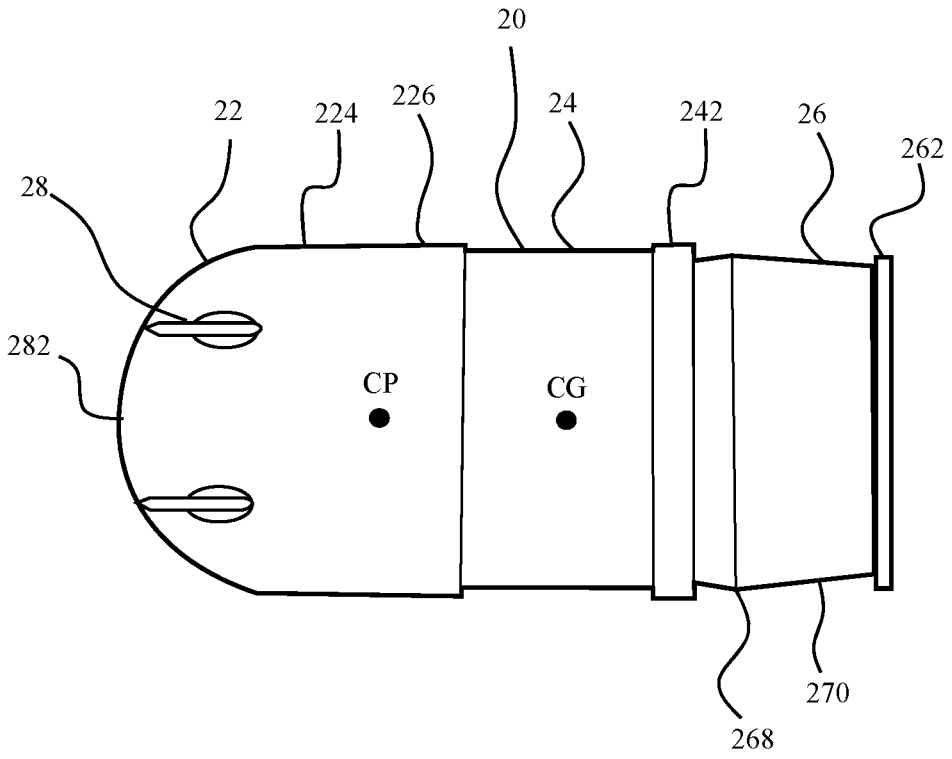
FIG. 4 is a side view of a HEMI projectile, according to an illustrative embodiment.

FIG. 4 is a side view of a HEMI projectile, according to an illustrative embodiment. The HEMI projectile 20 is an untethered spin stabilized projectile designed to be fired from a cartridge case through a rifled weapon barrel or tube. In the embodiment shown, the projectile 20 is a 40 mm projectile and is configured to be fired from a grenade launcher of that caliber.

The HEMI projectile 20 incorporates an electronic assembly housed within the projectile 20 which upon impact with a target delivers an electric waveform to the target intended to cause electro-muscular disruption (EMD) of the target.

Upon impact, four prongs, which are pin size steel barbs 28 in this embodiment, extend through the external surface of the ogive and contact the target. However, as described above, to be effective, the projectile 20 must be oriented along its flight path thereby allowing the prongs to embed in the target properly.

The center of pressure of the HEMI projectile 20 is forward of the center of gravity. In the embodiment shown, the center of pressure is approximately .7 caliber from the nose. The center of gravity is in the range of approximately 1.205 to approximately 1.281 caliber from the nose. As such, the projectile 20 comprises a gyroscopic stability factor (Sg) that is 1.0 or greater for stable flight.

The HEMI projectile 20 comprises an ogival nose region 22, a cylindrical midsection region 24 and a tail region 26. The ogival nose region 22 is formed from a deformable material such that upon impact, steel barbs for delivering the electric waveform embed through the material to contact the target. The ogival nose region 22 has a rounded nose 282 and a relatively large cylindrical diameter 224 which blends into a bore rider feature 226. The diameter of the ogival nose region 22 is larger in magnitude than the midsection region 24. The ogival nose region 22 is shaped such that the normal force on the ogive is lessened with the effect of shifting the overall center of pressure rearward.

The midsection region 24 of HEMI projectile is cylindrical in shape and has a constant diameter which is smaller than the diameter of the ogival nose region 22. A rotating band in the form of a circumferential ring 242 is located at the rear of the midsection region 24.

In an embodiment, the midsection region 24 and the tail region 26 of the HEMI projectile are integrally formed from a nylon plastic material.

The tail region 26 of the HEMI projectile steps down in diameter from the circumferential ring 242 and gradually increases in diameter in the direction away from the midsection region 24 until an apex point 268. From the apex point 268 rearward, the tail region 26 comprises a boattail shape 270. A circumferential base flange 262 is located at the base of the tail region 26. The base flange 262 serves to increase the amount of normal force behind the center of gravity. Increasing the amount of normal force behind the center of gravity has the effect of shifting the overall center of pressure rearward which reduces the overturning moment to increase the Sg.

The base flange 262 may be slotted or unslotted. In addition, in other embodiments, the base flange 262 may comprise one or more strakes extending from the base flange 262 and along the boattail section 270 to increase this effect.

In addition to the external features of the projectile 20, the internal contents of the HEMI are designed to provide favorable mass properties for gyroscopic stability.

While the invention has been described with reference to certain embodiments, numerous changes, alterations and modifications to the described embodiments are possible without departing from the spirit and scope of the invention as defined in the appended claims, and equivalents thereof.

What is claimed is:

1. An untethered HEMI projectile having a spin stabilized gyroscopically stable flight path, the projectile comprising:

a rounded ogival nose region;

a midsection region;

a base region further comprising a base flange;

one or more prongs which upon impact with a target, extend through an exterior surface of the rounded ogival region to deliver an electric waveform to an individual; and wherein the base flange and the rounded ogival nose region shift a center of pressure of the projectile rearward toward the center of gravity such that the projectile comprises a gyroscopic stability factor of 1.4 or greater.

2. The HEMI projectile of claim 1 wherein the projectile is a 40 mm projectile.

3. The HEMI projectile of claim 1 wherein the midsection region and the tail region are integrally formed from a nylon plastic material.

4. The HEMI projectile of claim 1 wherein the HEMI projectile has a gyroscopically stable flight range of at least 35 meters.

5. The HEMI projectile of claim 4 wherein the HEMI projectile has an angle of attack of less than or equal to five degrees during the gyroscopically stable flight range.

6. The HEMI projectile of claim 1 further comprising a bore rider, wherein the rounded nose and the bore rider have a blended transition.

7. The HEMI projectile of claim 1 wherein the base flange defines one or more angled slots.

8. The HEMI projectile of claim 7 wherein the tail region further comprises one or more strakes connecting the base flange to a boattail of the tail region.

9. The HEMI projectile of claim 7 wherein the projectile comprises a center of pressure that is .7 calibers from a nose of the projectile.

10. The HEMI projectile of claim 9 wherein the projectile comprises a center of gravity in the range of 1.205 to 1.281 from the nose of the projectile.

* * * * *